United States Patent [19]

Yoshida

[11] Patent Number: 4,523,445

[45] Date of Patent: Jun. 18, 1985

[54] HOT WORKING METHOD AND APPARATUS IN THE SWAGING WORKING TECHNOLOGY

[76] Inventor: Keiichiro Yoshida, 641, Mobara, Mobara City, Chiba Prefecture, Japan

[21] Appl. No.: 459,243

[22] Filed: Jan. 19, 1983

[30] Foreign Application Priority Data

Jan. 26, 1982 [JP] Japan ..... 57-10472

[51] Int. Cl.[3] ..... B21D 37/16; B21J 7/16; B21J 13/02

[52] U.S. Cl. ..... 72/69; 72/76; 72/342; 72/402

[58] Field of Search ..... 72/69, 76, 342, 402; 82/DIG. 1

[56] References Cited

U.S. PATENT DOCUMENTS

| | | | |
|---|---|---|---|
| 2,114,171 | 4/1938 | Benbow | 72/76 |
| 2,126,923 | 8/1938 | Romanelli | 72/69 |
| 2,617,319 | 11/1952 | Richards | 72/76 |
| 2,864,159 | 12/1958 | Doering et al. | 72/402 |
| 3,025,905 | 3/1962 | Haerr | 72/342 |
| 3,149,509 | 9/1964 | Oquist | 72/402 |
| 3,154,981 | 11/1964 | McDurmont | 72/402 |
| 3,221,531 | 12/1965 | Salter | 72/342 |
| 3,461,709 | 8/1969 | McMillen | 72/342 |
| 4,255,642 | 3/1981 | Livera | 72/76 |

FOREIGN PATENT DOCUMENTS

| | | | |
|---|---|---|---|
| 2751101 | 5/1979 | Fed. Rep. of Germany | 72/402 |

*Primary Examiner*—Lowell A. Larson

*Attorney, Agent, or Firm*—Wenderoth, Lind & Ponack

[57] ABSTRACT

The hot working method using a swaging machine provides for the minimizing heat transfer by the heat conduction from the preheated dies and work through the surrounding mechanical power transmission parts during the swaging process for the workpiece. The swaging machine has a die section including pairs of die elements and curved-profile buckers, the die elements having the working ends exposed toward the center beyond the inner sides of the corresponding buckers and the die elements and buckers being held together by means of steel balls, the motor-driven sectorial spindles for driving the die working section for rotation, the spindles and buckers being held together by means of steel balls, and springs for biasing the die working section toward the outside.

10 Claims, 6 Drawing Figures

HOT WORKING METHOD AND APPARATUS IN THE SWAGING WORKING TECHNOLOGY

FIELD OF THE INVENTION

The present invention relates generally to hot swaging technology in which workpieces such as a metal rod or tube are handled, and more particularly to method of and apparatus for causing workpieces to be subjected to the swaging process under the applied heat at temperatures of about 1000° C. Still more particularly, the hot working method according to the present invention consists of heating the dies and workpieces to the respective required temperatures and preventing transfer of the applied heat by conduction from occurring through the surrounding mechanical power transmission parts, thereby confining the heat locally for improved heat and working efficiencies. The workpiece can be finished to the desired shape by the swaging process under the locally confined heat. The apparatus provided by the present invention, which is used in practicing the method, comprises means for confining the applied heat locally and thus preventing it from being transferred by conduction through the surrounding parts other than the dies and workpieces to be heated, the arrangement of the heat conduction preventive means being such that the die set typically including three pieces is located innermost and the buckers which act as cams each having a curved profile are disposed outside the corresponding die pieces. The die set has its working side at the center with an aperture though which a workpiece is drawn so that the working side protrudes beyond the inner sides of the buckers toward the center, and the buckers and the side of the die elements opposite the working side are held together by means of sets of adjoining steel bearing balls. The individual buckers and the corresponding liners are also held together by means of sets of adjoining steel bearing balls so that the buckers can be moved relative to the liners in the radial direction, that is, toward the center, when the buckers are brought in contact with the surrounding rollers and back to the outside upon release from the rollers. The hot working method and swaging machine therefor provided by the present invention are a novel technology that provides a hot working process for the metal stock.

DESCRIPTION OF THE PRIOR ART

In most cases, the facilities provided by the conventional swaging machines are only for use in a cold working process for metal stock. In very rare cases, some swaging machines means to carry out warm working (the swaging operation takes place by heating a workpiece to a temperature of 300° to 500° C., for example) or hot working (the swaging operation takes place by heating a workpiece to 1400° C., for example). For both the warm swaging and hot swaging operations performed by those swaging machines, it can be observed that there are variations in the heating temperature during the drawing process, the product obtained is less reliable, and it is difficult to remove the oxides that are likely to be produced during the process. For this reason, the use of such swaging machines is limited to the particular cases where no other means are available for use. When handling metal powder stock that contains sintered powders, such as wires, rods and tubes that are less tough in strength, another swaging machine is known, which provides a hot forging operation for forming the stock to the required dimensions or shapes. In this case, however, a great difference in the heating temperature usually occurs between the dies and the workpiece. For example, for sintered tungsten rod stock to be subjected to the swaging process, the initial reduction takes place by causing the workpiece to be heated up to 1500° C. while the dies are heated to temperature between 200° C. and 300° C. In an environment in which a great temperature difference exists from the temperature of the workpiece, the workpiece temperature is quick to drop. Therefore, the stock that is to be handled by the operator must be restricted to relatively smalllength stock so that the operator can feed the stock into the swaging machine quickly and withdraw it well prior to a marked temperature fall or drop. Particularly for the reduction of tube thickness that takes place in a hot working environment, the tube stock has a much less thermal capacity than solid stock, and is much quicker to cool. Therefore, the conventional swaging machine cannot be used for hot swaging such as tube thickness reduction.

As clear from the foregoing description, the conventional swaging machines have disadvantages that are caused by the lack of any means that can confine the applied heat locally. Specifically, there is no means for preventing the heat conduction from the preheated dies through the surrounding mechanical power transmission parts. Therefore, the dies cannot be readily heated by applied heat and thus the workpiece is allowed to cool rapidly before the process is completed. This obliges the work to be heated and processed several or more times until the process is completed. Also, the temperature of the heating must greatly vary each time the work is heated. As such, constant working conditions cannot be achieved, leading to a marked drop in the working efficiency.

SUMMARY OF THE INVENTION

In order to obviate the disadvantages of the prior art swaging machines and methods, the present invention provides a novel technology in the swaging field. According to the present invention, heat conduction preventive means is included, which minimizes the heat transfer that may be caused by the heat conduction. To this end, the heat conduction preventive means includes a set of innermost dies and a set of buckers or cams acting upon the corresponding dies. The die set has its working side at the center protruding beyond the inner sides of the buckers toward the center, and the dies and the corresponding buckers are held together by means of a set of adjoining steel bearing balls. This construction permits wire, rod or tube stock of relatively small thermal capacity to be handled so that the stock can be finished in a continous manner without any intervening means for heating the stock. The working side of the dies is heated to 700° C. to 800° C. and is maintained at that temperature range, and the stock is fed into the dies at temperatures of about 1000° C. Therefore, the stock is being fed through the dies at the initial constant temperature because of a small temperature difference between the stock and the dies. The stock can be treated under the constant temperature ambient, thus making possible a continuous swaging process.

The method provided by the present invention is implemented by preventing the heat transfer by heat conduction from the dies through the surrounding power transmission parts and subjecting the workpieces to the swaging process by causing the workpieces and dies to be heated to the respective required temperatures. The heat transfer prevention is achieved by minimizing the contact area between the dies and the corresponding power transmission parts, locating the regions to be heated as far as possible away from the other non-heated regions, and causing the above contact area to be cooled.

The apparatus provided by the present invention includes means required to put the above method in practice. The swaging machine includes rollers arranged turnably on their axes around the outermost periphery of the housing and a set of dies equipped with the buckers which are arranged radially inside the roller arrangement, in which the operation of the dies is associated with that of the corresponding buckers which are power-driven for rotation together. The rotation of the die and bucker combination causes all the buckers to come in contact with the roller simultaneously. The rollers contacted by the buckers which have a curved profile move the buckers inwardly toward the center, which in turn move the associated dies toward the center so that the aperture formed by the dies is closed. Thus, the work can be drawn through the dies into the desired shape. In one specific feature of the construction according to the invention, the dies have their working sides, which form a center aperture, located closer to the center than the inner extremities of the buckers, the buckers and the sides of the dies opposite the working sides are held together by means of sets of adjoining steel bearing balls, the buckers and the spindles are also held together by means of sets of adjoining steel bearing balls, and each of the buckers and dies has a forced cooling means in the form of air holes.

Another feature of the present invention arising from the above feature is the arrangement of the steel bearing balls which hold the buckers and dies together so that the contact areas between the two elements is minimized effectively so as to keep the heat conduction to a minimum.

Another feature is the disposition of the dies with their working sides isolated in the control space from the other heat conducting parts. This disposition makes it possible to heat the working sides of the dies by means of the burner or similar heat source, and allows any additional device for conducting a process following the swaging process to be located in proximity to the outlet.

Still another feature is that the die and bucker combination is normally biased toward the surrounding rollers by resilient means such as springs that provide a pre-tensioning force. The buckers have a sine-curved profile on the sides facing the rollers, and function like a cam. During the rotation, the contact between the buckers and rollers is always maintained under the applied pressure provided by the springs.

A further feature is making the thickness of the spindles as small as feasible in the longitudinal direction so that the working sides of the dies can be completely exposed in the central space.

Another feature is causing the buckers and dies to be cooled without affecting the temperature of the heated workpieces.

BRIEF DESCRIPTION OF THE DRAWINGS

The above and other features and advantages of the present invention will become apparent from the detailed description of the preferred embodiments shown in the accompanying drawings, in which.

DESCRIPTION OF THE PREFERRED EMBODIMENTS

Several preferred embodiments of the method and apparatus provided by the present invention are described hereinafter in detail with reference to the accompanying drawings.

For convenience and better understanding of the features of the method according to the invention, a typical example of the experiments that were done to demonstrate the effectiveness of the method is presented. The method consists generally of heating the workpiece and dies to the respective required temperatures and maintaining the least difference between the temperatures. Under those conditions, the method can deal with a type of stock that has been difficult to handle with the conventional swaging process, and makes possible a continuous swaging process.

In a typical example, the object of the swaging reduction was tubular raw stock composed of molybdenum (Mo) and which has a 3 mm wall thickness and a 9 mm inner diameter. The wall was successfully reduced to 0.3 mm thick from the original dimensions. In the initial reduction provided by the hot swaging, the die assembly used was made of tungsten carbide, and was maintained at a constant temperature of 900° C. The core metal in the die assembly was also made of tungsten carbide, and was maintained in a constant temperature range of 800° C. and 850° C. when the stock was being passed through the aperture formed by the core metal of the dies. The measurement taken at the outlet of the swaging machine for the work which has been finished indicated that the metal was kept at the temperature of 900° C.

In the above case, the dies and core metal were both made of tungsten carbide and heated to nearly 900° C. exhibited a Rockwell hardness substantially equal to RC-50 while the work being processed in the conventional heated atmosphere exhibited a Rockwell hardness of RC-10 to 13. The result was that there was no problem with the hot working reduction.

As the reduction for the work progressed, it turned out that a hot working temperature of 600° C. was sufficient for finishing the work.

In the above example, the hot working could be accomplished by using dies and core metal which were made of a high speed steel of the group of molybdenum (JIS-SKH-9). In this case, the dies including the core metal had a Rockwell hardness equal to RC-52 to 51 at the hot temperature of 600° C., while the workpiece had a value of about RC-15. This also made the reduction successful. The hot working process as described above according to the method embodying the invention was carried out by placing all of the dies, core metal and work in an atmosphere heated by the flames that were produced by the propane oxygen burner.

Figure 4:
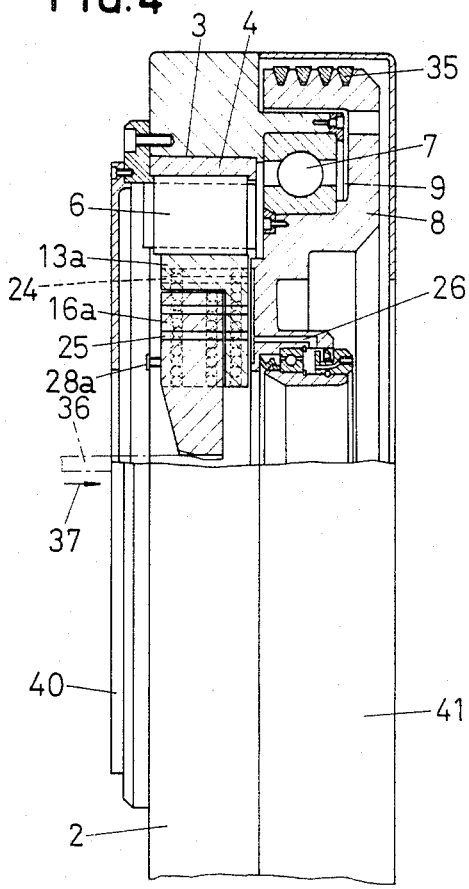
FIG. 4 is a longitudinal half section view of the apparatus of FIG. 1, showing the half portion of the operating mechanism.
Figure 5:
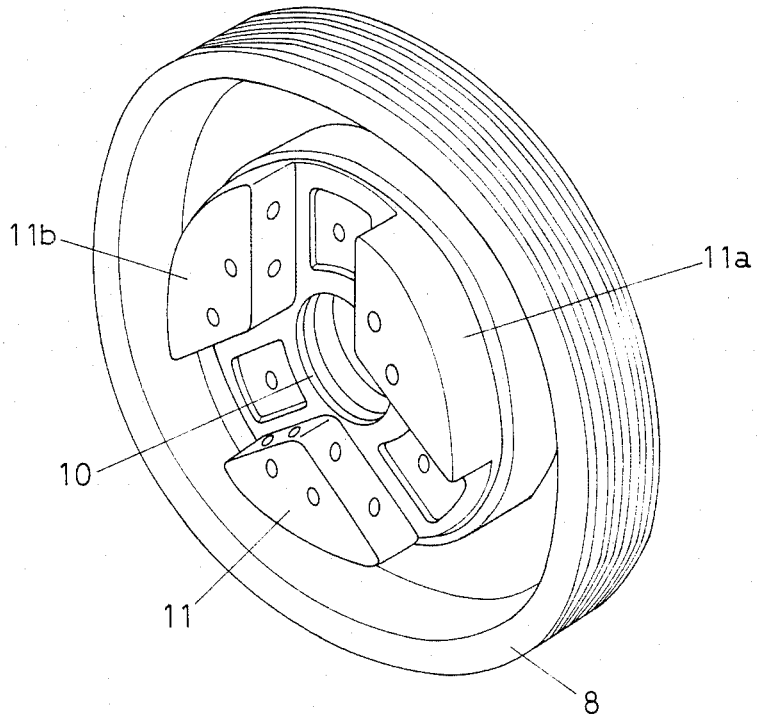
FIG. 5 is an enlarged perspective view illustrating the the pulley including the spindles.

The details of the apparatus to be used in practicing the above described method are illustrated in the accompanying drawing. The construction of the apparatus is as follows. A housing 2 made of a thick plate is disposed in an upright position on a machine pedestal 1, the upper half portion of the housing 2 having a round aperture 3 through the wide wall side (front wall). The peripheral edge of the round aperture 3 on the front side (the left-hand side in FIG. 4) has fitted therein with an outer race 4, the outer race 4 accommodating a plurality of rollers 6 (eighteen rollers are shown) which are regularly spaced by means of intervening roller racks 5 around the outer race 4. The rollers 6 are mounted for rotating around their axes. Behind the round aperture 3 (the rear side of which is slightly larger in diameter than the front side (See the right-hand side in FIG. 4), there is a rotor 8 which has a circumferential recess 9 on one side. A ball bearing 7 which is rigidly mounted on the housing 2 on the rear side is fitted within the recess 9 and on which the rotor 8 rotates. The rotor 8 has a central aperture 10 as shown in FIG. 5, and three spindles 11, 11*a* and 11*b* each having a sectorial shape in plan and having the thickness extending axially are disposed in regularly spaced relationship around the outside of the central aperture 10. Each of the sectorial spindles 11, 11*a* and 11*b* includes two liners 12, 12*a* and 12*b* which are secured to the opposite circumferential faces of the spindle, and the distance between the adjacent spindles including the opposed liners is wide enough to accommodate corresponding buckers 13, 13*a*, 13*b* between the liners. Each of the liners 12, 12*a* etc. has two parallel grooves 14 on the lateral wall facing the opposite liner and extending in the radial direction. Each of the grooves 14 has an arcuate shape in cross section. For simplicity, the liners are collectively referred to as the liner or liners 12 hereinafter. Each of the buckers 13, 13*a*, and 13*b*, the construction of which is to be described below is disposed between the corresponding opposed liners 12. Each of the buckers 13, 13*a* and 13*b* has a horseshoe shape with a curved profile at the top. The die construction includes three separate pieces 16, 16*a* and 16*b*, each of which has a part accommodated inside the corresponding bucker and a part which forms a working aperture together with the corresponding part of the remaining die pieces assembled on the pulley. As the buckers 13, 13*a*, and 13*b* have an identical construction, the following description of the bucker 13, for example, applied similarly to the remaining buckers 13*a* and 13*b*. The bucker 13 has two parallel grooves 17 on each of the opposite outside walls, each of the grooves having an arcuate cross-section and running in the radial direction such that the grooves match and are opposed to the corresponding groves 14 on the liner 12. Each pair of the grooves 14 and 17 contains an arrangement of adjoining steel balls 18, which are held together by means of flat springs 19 and 19*a* fixed to the inside and outside walls of the liner 12 so that the steel balls cannot escape from the grooves. The bucker 13 has two parallel grooves 20 running radially on each of the opposite inner walls, and each of the die pieces 16, 16*a* and 16*b* has two parallel grooves 21 on each of the opposite outer wall of the upper half portion opposite the lower working side portion, the grooves 21 being located opposite the corresponding grooves 20 on the bucker 13. Each pair of the opposite grooves 20 and 21 contains an arrangement of adjoining steel balls 22. The steel balls 22 are restrained from escape from the grooves by means of stop pins 23, which are inserted into axial, i.e. parallel to the pulley axis, grooves formed along the inner walls in proximity of the bottom of the bucker. Each of the buckers 13, 13*a*, and 13*b* has axial air holes 24 through the bucker, and each of the die parts 16, 16*a* and 16*b* has air holes 25 extending axially through it. All the air holes 24 and 25 are led to an air feed hole 26 formed in the central portion of the pulley 8. Each of the sectorial spindles 11, 11*a* and 11*b* carries a pair of fastening pins 27, 27*a* and 27*b*, respectively, and each of the die pieces 16, 16*a* and 16*b* carries a single fastening pin 28, 28*a*, 28*b* on the front lower side, respectively. Three flat springs 29, 29*a* and 29*b* have their opposite ends fastened to the pins on the spindles, with the mid-points engaging the pins on the die pieces. Specifically, for example, the flat spring 29 has its opposite ends fastened to the pins 27 and 27*a* on the spindles 11 and 11*a*, with the mid-point engaging the pin 28 on the die 16. The arrangement for the remaining flat springs 29*a* and 29*b* is the same. All the flat springs 29, 29*a* and 29*b* normally bias the corresponding die pieces 16, 16*a* and 16*b* toward the surrounding rollers.

Figure 6:
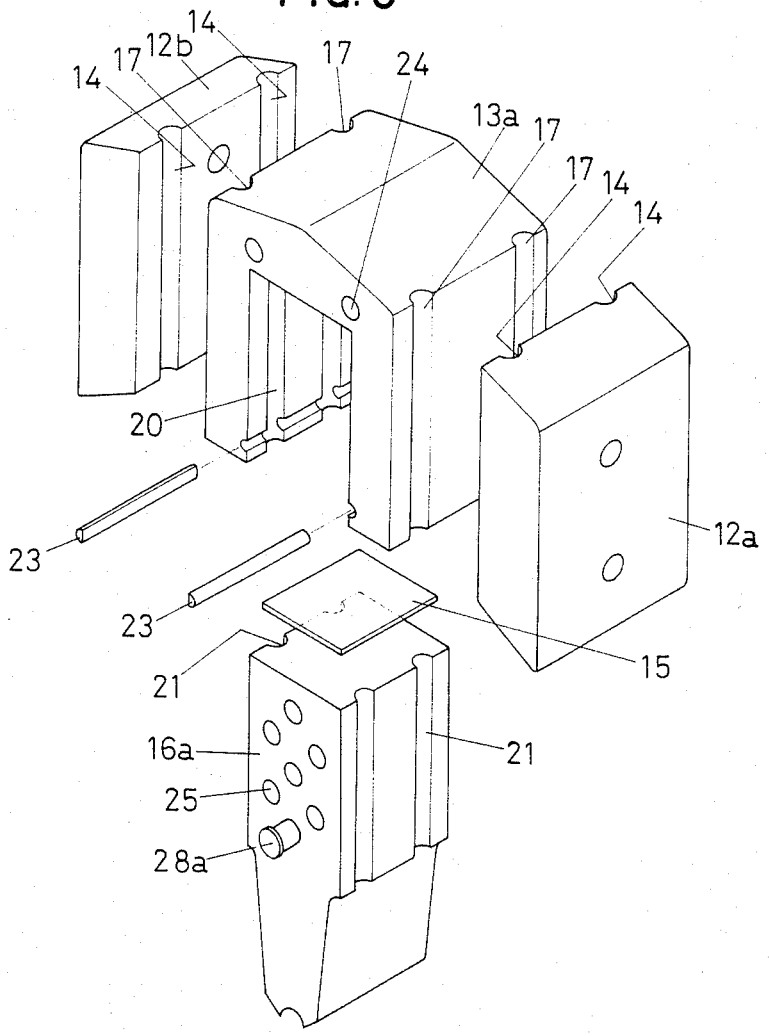
FIG. 6 is an exploded perspective view illustrating the pieces that form the liner bucker and die assembly.

An internally threaded aperture 30 is formed in the lower portion of the housing 2, and has a ring 32 threaded into it which fastens a motor 31 to the housing in a horizontal position. The shaft 33 of the motor 31 carries a V-grooved pulley 34, and a plurality of V-belts 35 are threaded around the outside of rotor 8 and pulley 34. In FIG. 6, reference numeral 15 designates a liner interposed between the die and the bucker inner wall.

In the preceding embodiment, the die assembly consists of three pieces which are arranged radially, but the number of the die pieces may be varied, such as two or four as appropriate. The die assembly should preferably be made of materials such as tungsten carbide that provide a hardness like special steel even when it is heated to a high temperature (for example, 800° C. ). The steel balls 18 and 22 should preferably be made of materials such as tungsten carbide, stainless steel and other special steels. The heater supplies for the die end according to the present invention may include gas burners $b_1$, $b_2$ and $b_3$ or other known heaters, therefore, the present invention is not limited to any particular type of the heater.

Figure 1:
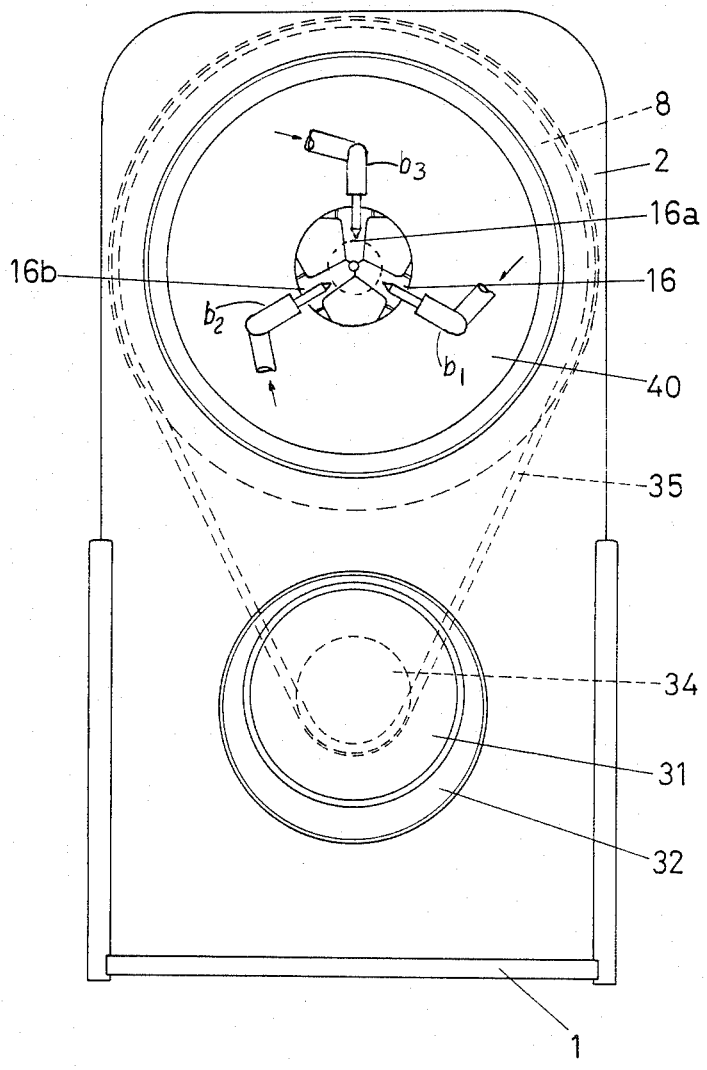
FIG. 1 is a front elevation of the apparatus embodying the present invention.
Figure 2:
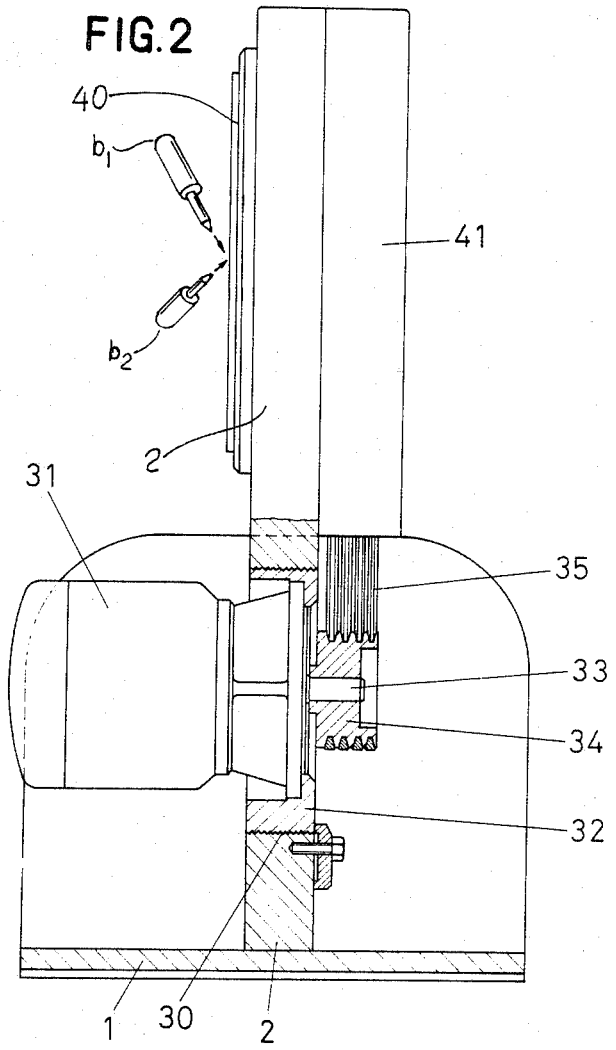
FIG. 2 is a side elevation of the apparatus of FIG. 1 with some internal parts shown.
Figure 3:
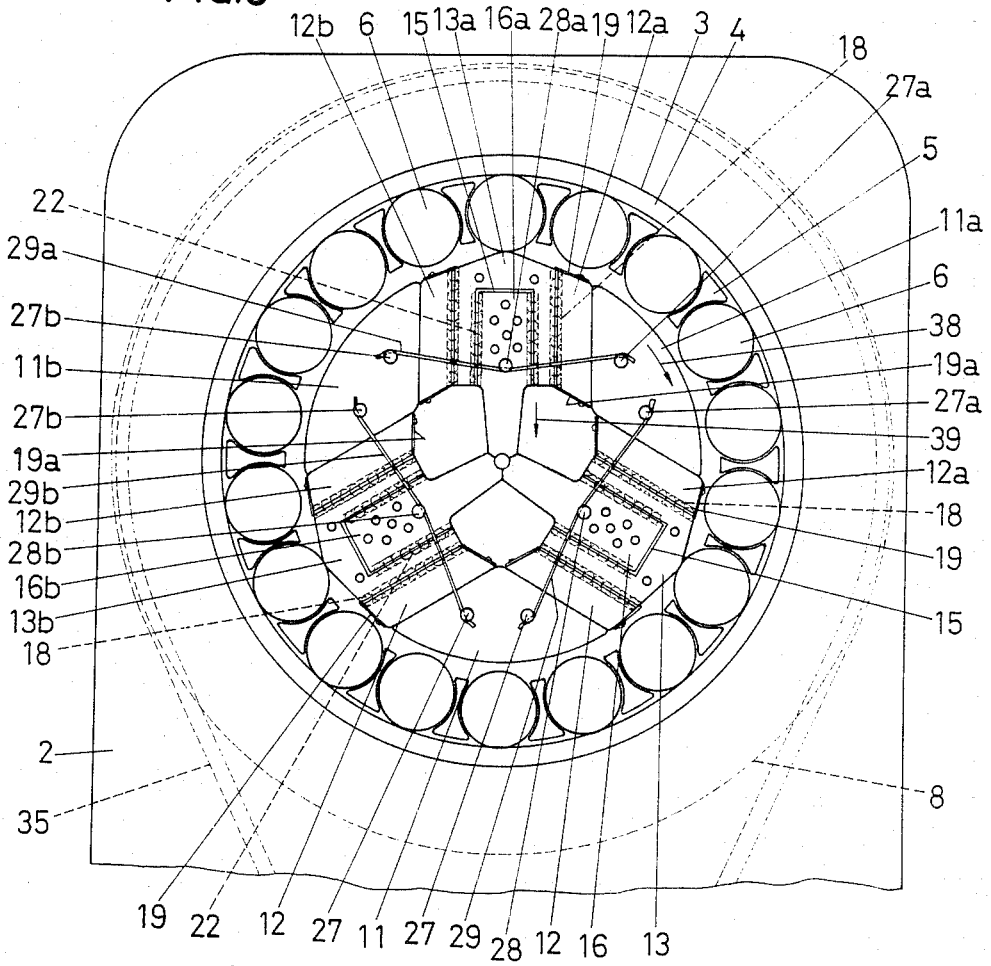
FIG. 3 is a partly enlarged front elevation of the apparatus of FIG. 1, with the cover removed to expose the internal arrangement of the associated parts or elements.

In the construction described above, the die assembly has its working end exposed in the central space as particularly shown in FIG. 3. As shown in FIG. 2, the construction of the apparatus includes no other devices in proximity that interefere with the operation of the stock working section. Therefore, any heating device for the stock and dies may be provided in proximity with the inlet side (left-hand side in FIG. 2), and means for keeping the just worked stock hot or an antioxydization room containing an atmosphere of inert gas, argon gas or hydrogen gas may be provided on the outlet side (right-hand side in FIG. 2) as required. In FIG. 2, reference numeral 40 denotes a front cover, and 41 denotes a rear cover.

The operation of the apparatus which has fully been described hereinabove is as follows. At the start of the operation, the motor 31 is turned on, and then a workpiece 36 such as metal rod or tube is heated to a proper temperature (for example, 1000° C.) and fed into the dies 13, 13*a*, 13*b* as indicated by the arrow 37 in FIG. 4.

During the work feeding, the dies are also heated to 800° C. locally on the inner ends thereof which define the aperture through which the work is to be drawn. The rotation of the motor 31 is imparted by the intermediate power transmission linkage including the pulley 34, belt 35 and pulley 8 to the sectorial spindles 11, 11*a*, 11*b*, which are then driven in rotation in the direction indicated by the arrow 38 (FIG. 3). The rotation of the spindles causes the rotation of the associated buckers 13, 13*a*, 13*b* in the identical direction. The buckers each having a curved profile on the outer side are brought into contact with the corresponding rollers 6, which force the buckers 13, 13*a*, 13*b* to be moved inwardly toward the center. The action of the buckers 13, 13*a*, 13*b* brings the corresponding dies 16, 16*a*, 16*b* toward the center so that the dies are placed in position for forming the work 36 to the desired shape. During the above operation, the working ends of the dies are always maintained at 800° C. and the preheated work 36 is placed in the heated atmosphere. As such, the work 36 can be finished through its entire length without any drop in its temperature. The contact between the dies and the corresponding buckers takes place by means of the bearing ball sets 22 and liners 12, 12*a*, 12*b*. The adjoining bearing balls in any set are arranged to be in point contact with each other so that the heat conduction can be minimized under the effect of the thermal saturation. The liners 12, 12*a*, and 12*b* each carrying air moving holes are kept cool by the air through the holes (the bearing balls are also subjected to the cooling action). Thus, the heat conduction through the liner regions can also be reduced. Furthermore, the buckers and the corresponding liners are separated by means of the bearing ball sets 18, which provide the same function as those between the dies and buckers. As such, the heat conduction can be reduced further. As a result, the heat conduction that would otherwise occur through the rollers and bearing balls can be prevented and can be minimized. Therefore, a rise in the temperature around the above parts can effectively be prevented so that no problem affecting the working efficiency is caused by the rising temperature.

As is clear from the foregoing description that has been made in connection with the method and apparatus, the present invention provides the following advantages. The constructional advantage is that the die assembly has its working ends exposed in the central space free of the other associated elements, so that both the stock and the working ends of the die assembly can be heated to the respective required temperatures without affecting the other parts. The continuous swaging operation can take place because it eliminates the need of reheating them during the process.

Another advantage is that the dies and buckers are held together by means of the adjoining steel balls, thus preventing the heat conduction through the other parts including the surrounding rollers and the steel balls.

A further advantage is that an open space is provided on the front and rear sides of the die assembly in order to allow other devices such as heaters to be installed without any restrictions. This provides for optimized working conditions.

Although the invention has been fully described with reference to the several preferred embodiments thereof, it should be understood that various changes and modifications may be made without departing from the scope of the invention.

What are claimed are:

1. A swaging machine for carrying out hot working, comprising:

a housing having a central opening therethrough;

rollers rotatably mounted in said housing around the periphery of said central opening for rotation around their respective axes;

a rotor rotatably mounted in said opening and having a plurality of guide means with radially extending guide surfaces thereon;

a plurality of radially extending buckers on said rotor and having ball bearings between said buckers and said guide surfaces forming the only contact between said buckers and said guide surfaces, said buckers having cam surfaces on the radially outer ends for engagement with said rollers for periodically urging said buckers radially inwardly when said rotor is rotated;

a plurality of die members, one mounted on each of said buckers for radial movement therewith and having ball bearings between said bucker and said die member forming the only contact between said die member and said bucker, the ends of said die members protruding beyond the inner ends of said buckers and being exposed in the center of said opening;

biasing means for urging said die member and the corresponding bucker radially outwardly;

means connected to said rotor for rotating said rotor; and heater means adjacent the inner ends of said die members for heating the inner ends of said die members.

2. A swaging machine as claimed in claim 1 wherein the die elements are made of tungsten carbide.

3. A swaging machine as claimed in claim 1 wherein each of the buckers has a generally horseshoe-shaped construction with said cam surface at the radially outer end and having two parallel arcuate-shape cross-section grooves extending longitudinally along each of the opposed inner walls of the legs of the horseshoe, and each of the die members has two parallel arcuate-shape cross-section grooves extending longitudinally along each of the opposite outer walls and opposed to the grooves on the buckers, the pairs of the corresponding grooves on the die members and buckers accommodating the ball bearings.

4. A swaging machine as claimed in claim 3 wherein the ball bearings are made of tungsten carbide or stainless steel.

5. A swaging machine as claimed in claim 1 wherein each of said guide means has a liner on the guide surface thereof, each bucker having two parallel arcuate-shape cross-section grooves extending longitudinally on each of the opposite lateral sides thereof and each liner having two parallel arcuate-shape cross-section grooves on the surface facing the bucker and corresponding to the grooves in the bucker, each pair of the corresponding grooves on the bucker and liner accommodating said ball bearings.

6. A swaging machine as claimed in claim 5 wherein the ball bearings are made of tungsten carbide or stainless steel.

7. A swaging machine as claimed in claim 1 wherein the ball bearings are made of tungsten carbide or stainless steel.

8. A swaging machine as claimed in claim 1 further comprising means for cooling the die elements and buckers, respectively.

9. A swaging machine as claimed in claim 8 wherein said cooling means comprises air holes through each of the die members and buckers, and means for causing pressurized air to flow therethrough.

10. A swaging machine as claimed in claim 1 wherein said biasing means comprises a flat spring extending across each die member, the opposite ends of the flat spring being fastened to the guide means on the opposite sides of the die member, and a pin on the die member engaged by the mid-point of the flat spring, said flat spring biasing the die member toward the rollers through said pin.

* * * * *